United States Patent [19]

Bangs

[11] Patent Number: 4,922,068

[45] Date of Patent: May 1, 1990

[54] DENSIFIED BRAIDED SWITCH CONTACT

[76] Inventor: Edmund R. Bangs, 6438 Pontiac Dr., Indian Head Park, Ill. 60525

[21] Appl. No.: 199,120

[22] Filed: May 26, 1988

[51] Int. Cl.[5] ..... H01H 1/20

[52] U.S. Cl. ..... 200/271; 200/273; 200/265; 200/266; 200/267; 200/268; 439/877; 439/887

[58] Field of Search ..... 200/271–274, 200/265, 266, 267, 268; 439/874, 875, 877, 878, 879, 880, 883, 884, 886, 887

[56] References Cited

U.S. PATENT DOCUMENTS

| | | | |
|---|---|---|---|
| 2,806,113 | 9/1957 | Romer | 200/265 |
| 3,143,626 | 8/1964 | Schreiner et al. | 200/265 |
| 3,895,851 | 7/1975 | Bolton et al. | 439/878 X |
| 3,973,823 | 8/1976 | Stanback et al. | 439/877 |
| 4,314,848 | 2/1982 | Todoroki et al. | 200/266 X |
| 4,394,533 | 7/1983 | Naito | 439/877 X |
| 4,447,109 | 5/1984 | Habnet, Jr. | 439/886 |
| 4,683,358 | 7/1987 | Dittmann | 200/243 |

FOREIGN PATENT DOCUMENTS

| | | | |
|---|---|---|---|
| 665693 | 6/1965 | Belgium | 200/271 |
| 1218594 | 6/1966 | Fed. Rep. of Germany | 200/271 |

*Primary Examiner*—Ernest G. Cusick

*Attorney, Agent, or Firm*—Fitch, Even, Tabin & Flannery

[57] ABSTRACT

An electrical switch assembly is made with a braided electrical conductor having a densified end which has reduced porosity from the braided wire. Preferably, the densified end is formed by squeezing copper wires with a solder matrix to reduce the air in the densified end so that it has over 95% solids. A solder layer is formed between the densified end and the switch element, preferably by using a foil of silver braze which is melted between the densified end and the switch element. In the preferred method of forming the densified end, the solder and copper are heated and squeezed at pressures in the range of 500–750 pounds under a liquid blanket of material to limit copper oxidation.

7 Claims, 2 Drawing Sheets

DENSIFIED BRAIDED SWITCH CONTACT

This invention relates to the elongated, flexible electrical braided cables or conductors made of copper, and more particularly, to switch elements using such braided copper conductors and to the method of manufacturing such braided conductors and switches.

BACKGROUND OF THE INVENTION

In some applications braided conductors of copper strands made of a large number of copper wires are used to provide a flexible, bendable electrical conductor between a movable contact arm and another element such as a connecting bar or a bus bar. One example is a switch gear which is used in emergencies when the normal electrical service is down to disconnect the outside electrical service and to connect the electrical current from a diesel generating set to the building or institution's power circuits. Such equipment includes a gear switch having pivotable, electrical switch elements which are the building contacts. These switch elements include braided electrical conductors which are connected at opposite ends to a solid bar or bus bar. It is the pivotable movement of the switch element that elongates the braided conductor and high current flows through these bendable, braided copper conductors necessitating that there be a good electrical joint or interface between the ends of the braided copper conductors and the pivotable switch element and the bar.

One approach to electrically join an end of a braided copper conductor assembly and the movable switch element is to have a resistance weld therebetween. However, it has been found that the resistance weld provides a poor joint in that the electrical resistance is high at the weld, it tends to heat up and some times is structurally weak. Specification 1108 of the Underwriter Laboratory states that there is a potential for failure if the joint heats, and that resistance welded connections that heat up at an unacceptable rate and level will not pass this specification. In order to provide a better electrical conjunction between the braided conductor and the pivotal switch element, silver braze has been used to braze a joint because silver braze has a better electrical conductivity and provides greater contact area than the resistance weld. However, it has been found that when soldering or brazing as stranded braided cable strands of the copper conductor tends to absorb the molten alloy by capillary action into the braided adjacent stranding. Eventually the solder or braze alloy solidifies so that the braided cable is no longer as flexible and becomes relatively stiff adjacent the joint. The stiffened braid now restricts movement of the movable contact creating operational failure. The cable is now vulnerable to breakage under repetitive pivoting of the switch elements. The wicking-out of the braze during the resistance brazing also tends to starve the braze at the joint interface so that there is a poor electrical and thermal conduction between the ends of the braided copper conductor and the movable switch element.

Additionally, the prior art methods of trying to weld or otherwise braze directly the copper wire ends with and without fittings to the terminal surfaces on a terminal bar and on contact arms has been a relatively time-consuming and laborious process with each wire end being manually positioned and welded.

Thus, there is a need to provide a good, electrical connection at the interface between the braided conductor and a terminal surface at either one or both ends of the braided conductors and one which can be done inexpensively and quickly.

Accordingly, a general object of the present invention is to provide a new and improved electrical braided copper conductor.

Another object of the invention is to provide a new and improved process for manufacture of a densified end on the end of an electrical braided copper conductor.

A still further object of the invention is to provide a new and improved switch assembly in which there is provided a brazed or soldered connection between a densified end of a braided electrical assembly connector and a switch element.

These and other objects and advantages of the invention will become apparent when taken in connection with the accompanied drawings in which:

DESCRIPTION OF THE PREFERRED EMBODIMENTS

Figure 5:
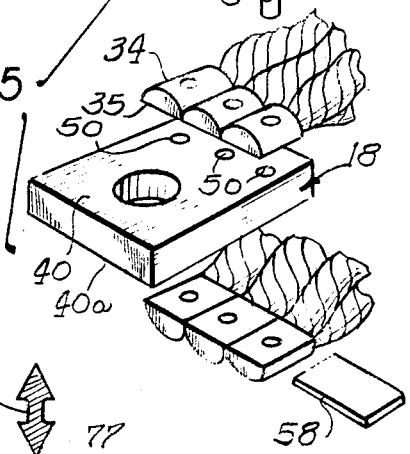
FIG. 5 illustrates an exploded view of a mechanical connection of the braided conductors to a terminal which allows for automated pre-assembly and positioning for brazing.
Figure 4:
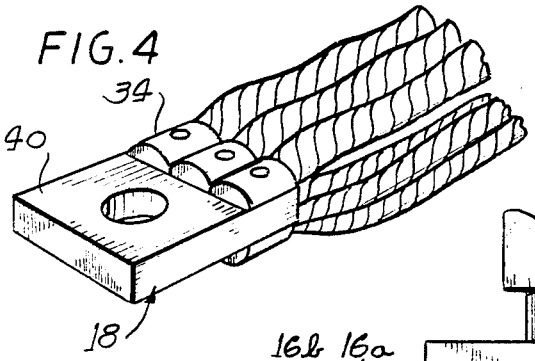
FIG. 4 is an enlarged view showing three braided conductors connected to a terminal.

As shown in the drawing for purposes for illustration, the invention is embodied in an electrical switch 10 which includes a switch contact arm or member 11, which is pivotably about a horizontal pivot pin 12 to swing a contact 14 at one end into engagement with a stationary contact 15 when there is a break-down in the normal electrical service to a plant or installation and there is a start-up of a diesel generator or other auxiliary power source. The electricity flows through the engaged contacts 14 and 15 and through the switch element 11, which is also made of copper, and then through a pair of flexible electrical braided copper cable assemblies or conductors 16 which extend from the switch element 11 to another terminal or switch element 18 which is in the form of a terminal surface or bar as best seen in FIG. 5. The terminal surface or bar 18 may be connected to a suitable bus bar or other device. The bar may be silver plated or unplated. Thus, the current will flow through the terminal bar 18 through the flexible braided electrical conductors 16 to the pivotably mounted switch element 11 which pivots around the pivot pin 12 to bring the contact 14 against a contact surface 15 to complete the electrical path. The braided wire electrical conductors 16 are formed of a plurality of strands **16*a* and 16*b* which can be twisted in a variety of geometric paths so as to form a conductor which is flexible. These conductors 16 are commonly called braided conductors or braided wires and may consist of one or more braided cables. The helical shape allows elongation and shortening of the conductor path depending on which way the end 28 of the braided conductor is moved by the switch finger 11 as it pivots. Herein, the braided conductors 16** are double copper braided cables joined at their opposite ends.

The problem addressed by the present invention is how to make braided copper conductors 16 which will provide good electrical and thermal contact between the switch element 18 and/or switch element surfaces 22 and 23 on the switch element itself. Attempts have been made to resistance weld the copper stranded or braided conductors 16 to the surfaces 22 and 23 on the switch element 11 and likewise to the switch element surface 18. However, the electrical resistance welding has been found to provide an area of high resistivity which heats when the current flows through the conductor elements. This build-up of heat is a source of potential failure and may result in a poor joint which will not pass many of the Underwriter Laboratory specifications necessary for such switching elements in switch gears. It is to be understood that the illustrated switch 10 is but one use for these braided conductors 16, and that many other uses are contemplated. Attempts have been made to use a silver solder and tin-lead solder or brazing material which has a better electrical conductivity than a resistance weld so that the joint does not heat up prior to the development of the densified end. The problem with such application of liquid or paste silver braze to the undensified strands was that the solder would wick-up into the immediate area as well as areas **16*c* of the strands adjacent the joint leaving less solder at the joint thereby tending to starve the joint, particularly when heat and pressure were applied to complete the brazing. Thus, there would be starved solder at the interface or joint 25 between the braided conductor elements and the switch elements 18, 22 or 23**. Additionally, such an operation was found to be slow and to be costly in the manual labor to complete the connection.

In accordance with the present invention there is provided a new an improved braided copper conductor or cable 16 which has integral densified ends 28 which may be readily soldered or brazed to a switch element 18, 22 or 23. As will be explained in greater detail, the highly densified end 28 is formed with a conductive matrix material such as a silver solder flux 29 within which the braided copper wire melted composite is infiltrated with melted solder alloy and compacted in a variety of geometries to provide an easily soldered joint which is so electrically conducting that it will not heat up. Also, as will be explained hereinafter in greater detail, another aspect of the invention is to mechanically interconnect all of the braided cables 16, the switch contact arm 11, and the terminal bars 18 into a subassembly for insertion into a resistance welding machine to form a final solder or brazing connection.

In accordance with another aspect of the invention there is provided a unique method and apparatus for the manufacture of the electrical braided, copper conductors 16 with their densified ends 28. Such a manufacturing apparatus includes a process for densifying the end with a shaped configuration and doing it without oxidation of the copper as would interfere with its electrical transmission abilities, would increase its resistivity and degrade its structural integrity.

Figure 1:
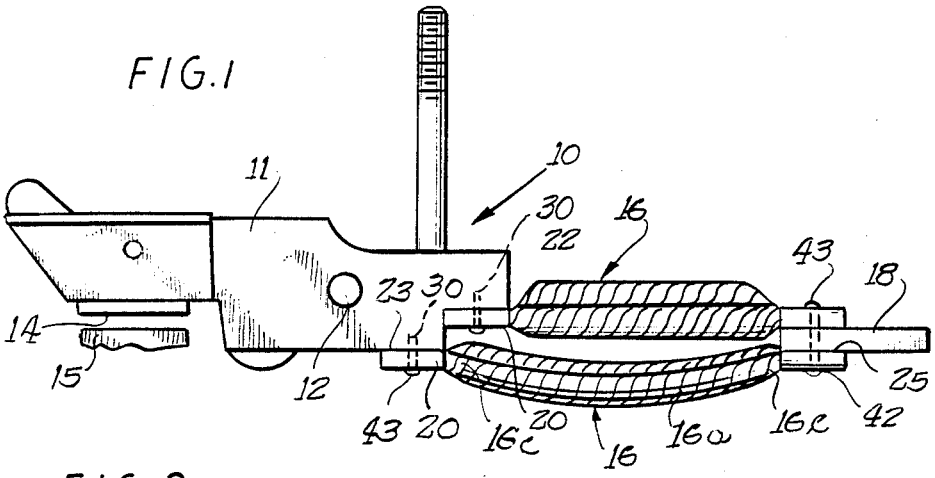
FIG. 1 is a side elevational view showing a typical electrical switch and movable contacts having a braided conductor assembly.
Figure 2:
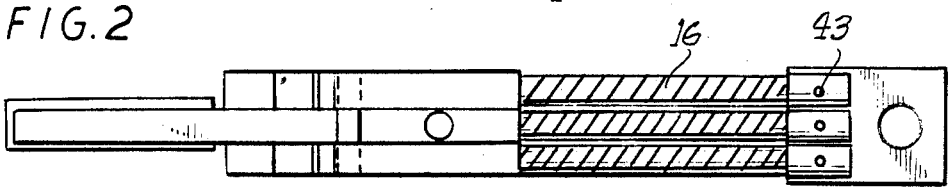
FIG. 2 is a plan view of the switch of FIG. 1.
Figure 3:
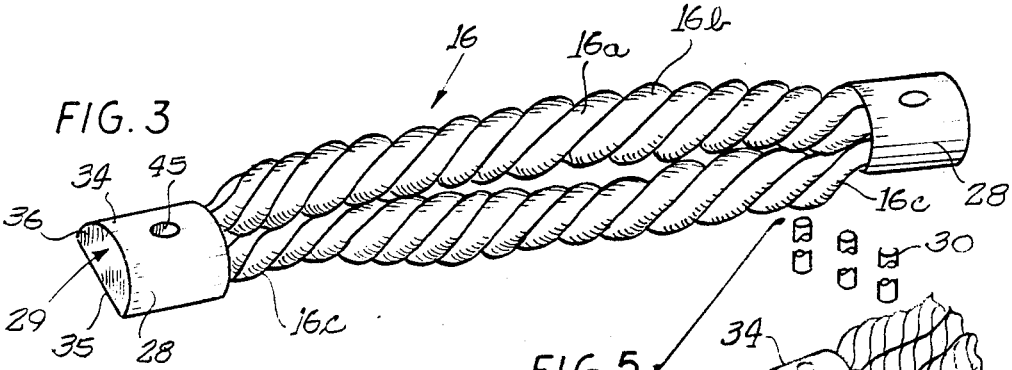
FIG. 3 is an enlarged view of a copper braided conductor assembly constructed with (2) standard copper cables in accordance with the preferred embodiment of the invention.

Referring now in greater detail to the preferred and illustrated braided conductor 16, it is shown as provided with a densified end 28, which has an upper generally hemispherical surface 34 and a bottom flat horizontal surface 35 and a flat end wall 36 joining the ends of two separate cables, as shown in FIG. 3.

Figure 9:
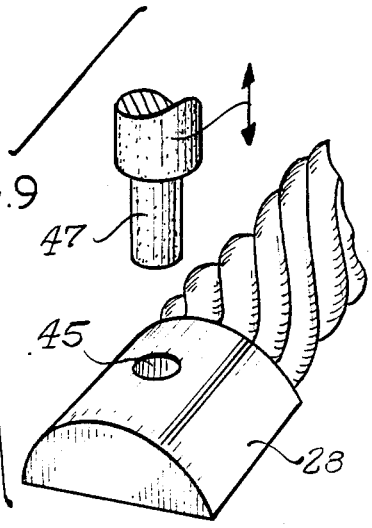
FIG. 9 illustrates a punch for forming a hole in a densified end of the braided conductor.

An improved an low cost switch 10 is provided by having the flat ends surfaces 35 on the densified ends connected by a fastener 30 to one of the surfaces 40 or **40*a* of a switch element, such as the switch element 18 shown in FIG. 5. The illustrated and preferred fastener 30 may be pins or rivets which may have their heads enlarged, as shown diagrammatically by enlarged heads 42 and 43 on the rivet 30 in FIG. 10. The illustrated rivets 30 are sized to fit through holes or openings 45 formed in the densified end 28 such as by a punch 47 shown in FIG. 9 which is forced through the densified end 28 to form a hole 45 completely through the densified end, as clearly shown in FIG. 10**.

The switch 10 is assembled with terminals 18 and the switch element 11 connected by these mechanical rivets 30 to the densified ends of the braided conductors 16 in the exact position desired prior to the resistance welding which causes the brazing or soldering material to flow to form the final joint connection, as will be explained in greater detail hereinafter. These particular mechanical interconnections have been found to be most useful in allowing an automated assembly of the switch elements and their final assembly prior to being positioned into the resistance welding unit, which will complete the brazing operation, as will be described hereinafter.

As best seen in FIG. 5, the terminal 18 as well as the terminal surfaces 22 and 23 are each provided with a series of aligned openings 50 which are sized to permit the rivets 30 to pass through. The rivets are pushed through the holes 45 in the densified ends 28 and through a silver braze foil 58 and then the holes 50 in the terminal elements 18, 22 and 23. Manifestly, various other mechanical fasteners or connectors may be used other than these pin rivets 30. For instance, screws or other particular fasteners may be used to mechanically hold the switch elements and densified ends in position for the final brazing or soldering operation.

Figure 10:
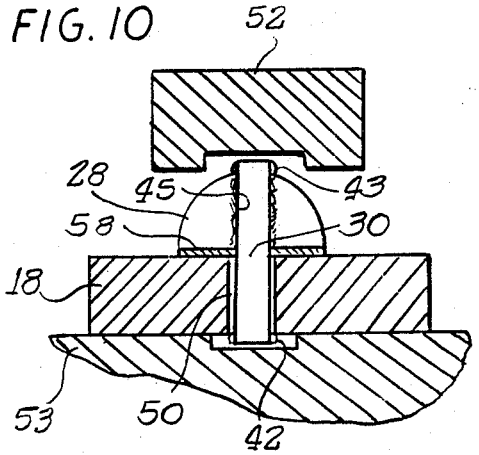
FIG. 10 illustrates an apparatus for riveting the densified conductor end to the switch bar and to a solder or braze alloy preform.

Referring to FIG. 10 the preferred and illustrated embodiment of the invention, the silver braze is melted and pressed about the copper strands which are also compressed tightly together in a matrix of silver rich solder alloy to remove the air in and about the strands of copper. The preferred silver braze used for the densification has a higher melting point than does the silver braze foil 58 which is placed between the flat planar surface 35 on the densified end 28 and the adjacent terminal surface 18, 22 or 23. The densification results in the copper wires being compacted, brazed in place by the molten alloy and the air being squeezed out to form a high density solid bar of copper metal and silver joining integral the strands and wires of the, in this instance, two strand cables comprising the illustrated conductors.

The foil 58 of braze is mechanically positioned between the densified end 28 as best seen in FIG. 10 prior to the riveting to forming the heads 42 and 43 so that upon the completion of the riveting there is an assemblage riveted together which includes a thin foil 58 of unmelted braze held by the rivets 30 between the densified ends 28 and the terminal surfaces 18, 22 and 23. By way of example only, the lower melting point silver braze used for the foil 58 may be a braze alloy composition which is 35% silver, 26% copper, 21% zinc, and 18% cadium.

After having assembled all the switch components and having riveted the same together with the foils 58 in position to form a subassembly, the subassembly is taken to a resistance welder or other soldering device which will heat up and melt the braze foils 58 which because of its lower melting temperature will melt and flow to make the electrical connections without the densified ends also melting. Thus, a silver braze layer joins the silver and copper in the densified ends 28 to the bars 18 and to the contact arms 11.

Figure 6:
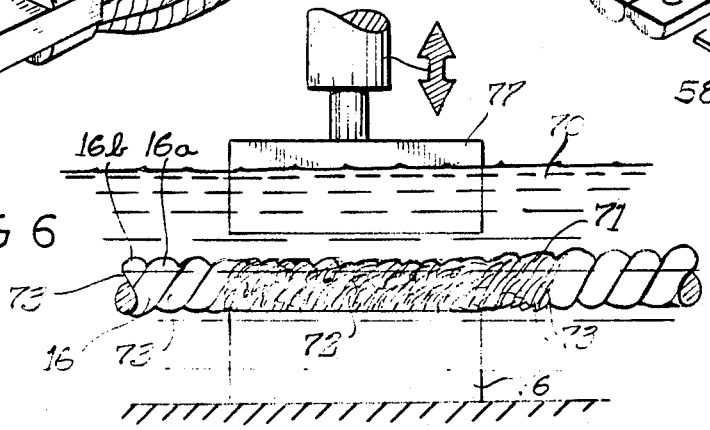
FIG. 6 is a diagrammatic view of an apparatus for densifying a copper braided conductor.

The preferred and inexpensive way to manufacture the densified ends 28 for the conductors 16 will now be described hereinafter in connection with FIGS. 6, 7 and 8. Referring first to FIG. 6, an elongated braided copper conductor element 16 having a number of strands **16*a* and 16*b* is coated with a heavy coating of silver brazing paste 72 which may be pushed between and about the respective strands and the wires in the strands 73, which make up each strand 16*a* and 16*b*. Under the blanket of a non-oxidizing medium 70 (FIG. 7), which in this instance is flux, there is provided an underlying electrode anvil 76 and an upper shaped electrode die 77 which is pushed by a ram 78 under hydraulic or other pressure to apply between 500–750 lbs. of pressure. The electrodes 76 and 77 are connected by electrical wires 80 to a welder of a 150–350 kva capacity to heat the copper wires and to melt the high temperature silver braze which melts at a temperature between 800°–1600° F. Preferably, the silver braze used to form the matrix has a melting temperature substantially greater than 800° which is the lower end of the range. The melting point point for the thin foil 58** of silver brazing material, above described, is closer to the 800° F. temperature.

It has been found that this pressure and heating provides a densification of about 95%, thereby eliminating substantially most of the voids of air which are commonly found between the thin wires and about the individual strand **16*a* and 16*b* of the electrical conductor 16. The densified end has the appearance of an integral bar of copper joining a pair of braid conductors 16 at each of their respective ends. The illustrated conductor assemblies 16 each have two cables of multiple strands that are compacted into a size smaller than the twelve strands. The solid densified rigid structure, which may be readily punched with a punch 47 to form the hole 45 and which may be readily connected by a rivet 30**, as above described.

Figure 7:
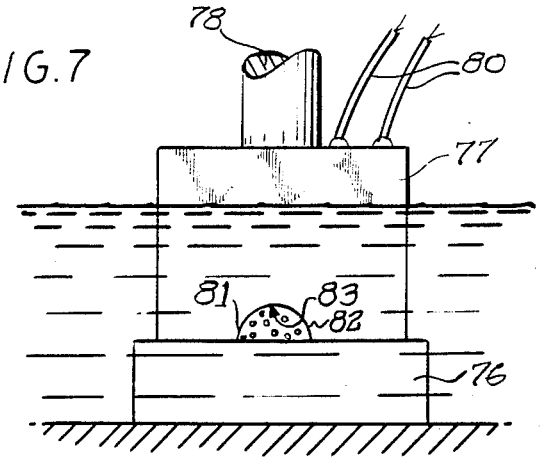
FIG. 7 is an end view of the apparatus of FIG. 6 showing the densifying of the copper braided conductor.

Another important aspect of the particular design of the equipment, shown in FIGS. 6 and 7, is to provide an electrode design which is acting as a heating element and is made of special materials such as tungsten or graphite electrodes for the lower anvil electrode 76 and the upper die electrode 77. The standard copper electrodes of a conventional welder for the respective die 77 and anvil 76 do not work as the copper dies and anvils conduct heat away from the copper braided conductor leaving insufficient heat required for densification. The graphite or tungsten bearing alloy electrode dies and anvils work as resistors that heat up to melt the silver solder paste which infiltrates the copper wire composite to form a solid metal end 28. As a substitute for using graphite for the electrodes 77 and 76, one may also use a tungsten ferro composition which will provide the resistivity to allow the copper and silver to melt the same into an integral mass. As best seen in FIG. 7, the sides 81 and 82 of a cavity 83 in the die are drafted, i.e. inclined to allow the shaped end 28 to be easily pulled from the die to preventing sticking of the shaped end in the die cavity.

Figure 8:
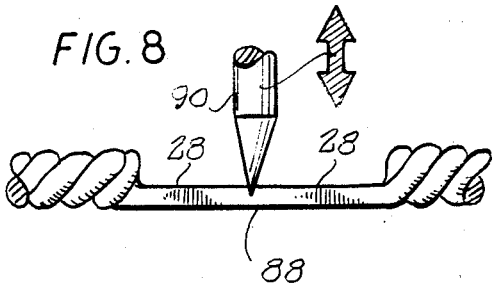
FIG. 8 is a diagrammatic view of severing the densified portion of the electrical conductor to form individual electrical conductors.

After a portion of the braided conductor has been densified as shown in FIG. 8, it is preferably severed at a midpoint 88 to form two separated densified ends 28 adjacent each other. That is, a shear 90 may be used to sever the densified portion at its midpoint 88 to form the two individual, now separated, connector elements 16. In the preferred manufacture, a plurality of one inch portions are coated with the silver braze plate and then placed between the electrodes to form one inch densified portions which are cut and punched simultaneously to form one-half densified ends 28.

It will be seen that the process prevents the oxidation because it is either covered by flux or is under water. Oxidizing of the wires has been found to be bad in that the wires may be cleaned with a chemical but it has been found that such chemical cleaning treatments have a tendency to eat away the small gage wires eventually causing structural failure which is evidenced by a roughened, fuzzy surface appearance.

While the braided conductors 16 illustrated herein have been has been cylindrical or round is, it is, of course, within the purview of the invention that the braided copper conductors 16 be relatively flat or rectangular in cross section. Manifestly, the electrical conductors with the densified ends may be used in many different applications from the illustrated switch 10, which is but one illustrated embodiment of the invention.

As used herein, the term "solder" is intended to be generic to brazing as well as to soldering. Usually the term "solder" is used to described a lower temperature operation using a tin lead or low temperature having a melting point of 800° F. or less and the term solder "braze" is used to describe compositions such as a silver braze having a melting point between 800° to 1600° F. Manifestly, the present invention does not depend on the particular brazing material used or the particular soldering material used, or the particular temperature used to form the densification and the matrix of the soldering or brazing material in the densified end 28.

Other modifications and adaptations may fall within the purview of he appended claims.

What is claimed is:

1. In a switch assembly, the combination comprising:

a braided, electrical conductor formed of strands of copper wire to provide a flexible electrical conductor, a switch element for connection to the flexible, electrical conductor, a densified end on the braided conductor for connection to the switch element, said densified end having a solder material therein to provide a reduced porosity from the braided conductor, and a solder layer formed between the densified end and the switch element.

2. A switch assembly in accordance with claim 1 in which the solder layer comprises a layer of silver braze.

3. A switch assembly in accordance with claim 2 in which the layer of silver braze was in the form of a foil prior to a melting thereof.

4. A switch assembly in accordance with claim 1 in which the densified end comprises a solid matrix of silver alloy and copper wire with a density of at least 95% solids.

5. A switch assembly in accordance with claim 4 in which the switch element is a rotatable switch contact.

6. A switch assembly in accordance with claim 4 in which the switch element is a terminal bar.

7. A switch assembly in accordance with claim 4 in which a mechanical fastener connects the densified end to the switch element.

* * * * *